US005634223A

United States Patent [19]

Obermaier

[11] Patent Number: 5,634,223

[45] Date of Patent: Jun. 3, 1997

[54] HOLLOW BODY FOR USE AS SEAT PAD

[75] Inventor: Anton Obermaier, Prien, Germany

[73] Assignee: Gebruder Obermaier OHG, Germany

[21] Appl. No.: 540,559

[22] Filed: Oct. 6, 1995

[30] Foreign Application Priority Data

Oct. 6, 1994 [DE] Germany ..... 94 16 126 U

[51] Int. Cl.[6] ..... B68G 5/00

[52] U.S. Cl. ..... 5/654; 5/925; 297/452.41; 297/452.65

[58] Field of Search ..... 297/452.41, 452.65, 297/452.22; 5/654, 653, 925, 449, 944, 706; 292/452.22

[56] References Cited

U.S. PATENT DOCUMENTS

| | | | |
|---|---|---|---|
| 587,224 | 7/1897 | McKelvey | 297/452.41 |
| 3,533,113 | 10/1970 | Stamberger | 297/452.65 |
| 4,445,240 | 5/1984 | Voorhees | 5/654 |
| 5,003,653 | 4/1991 | Mar | 5/449 |
| 5,333,336 | 8/1994 | Langsam | 5/654 |

*Primary Examiner*—Peter M. Cuomo
*Assistant Examiner*—Anthony D. Barfield
*Attorney, Agent, or Firm*—Anthony J. Casella; Gerald E. Hespos

[57] ABSTRACT

A hollow body for use as a seat pad is provided. The hollow body includes a generally planar resting region, a generally planar sitting region substantially parallel to the resting region and a transition region extending therebetween. The transition region is of generally donut or toroid shape. The resting region, sitting region and toroid region may be formed from a plastic skin. Hollow interior portions may be filled with a fluid.

18 Claims, 2 Drawing Sheets

HOLLOW BODY FOR USE AS SEAT PAD

BACKGROUND OF THE INVENTION

1. Field of the Invention

The present invention relates to a hollow body for use as seat pad having a resting region, a sitting region, and a transition region arranged between them.

2. Description of the Prior Art

In general, seat pads are known which are developed in the form of cushions (seat cushions). These seat pads are, on the one hand, filled with elastic or resilient filling material, for instance springs, foam, or the like, and, on the other hand, are developed as air cushions, the stiffness of the seat pad being obtained by a volume of gas enclosed in the seat pad.

These known seat pads, however, lead to a sitting position which is ergonomically incorrect and to continuous improper stressing of the body. Cramps, tenseness or even permanent damage to health (for instance, curvature of the spine) can be caused thereby.

On the other hand, it is known that seat balls result in an ergonomically advantageous sitting position in that the body is induced to effect continuous movements of equalization (so-called "dynamic sitting").

Due to their shape, such seat balls require a support or holding structure so that they do not roll away. Government institutions, for instance schools, have prohibited the use of such seat balls in areas accessible to the public, in particular because of the danger of their rolling away. If a backrest for the seat is desired, the holding structure is more elaborate and thus more expensive.

SUMMARY OF THE INVENTION

The object of the present invention is to provide a seat pad of simple development and handling which, upon use, results in an ergonomically favorable sitting position or attitude, particularly dynamic sitting, of the person seated thereon.

This and other objects are achieved by a hollow body for use as a seat pad having a resting region, a sitting region and a transition region between them, the resting region and the sitting region being substantially flat and the transition region being of bead, toroid or donut shape.

A hollow body in accordance with the present invention leads to a dynamic seat of the person sitting on the hollow body, as a result of which tension, continuous improper stresses, nerve irritations and conditions of pain in the lumbar and spinal regions are avoided or in part mitigated or cured.

In addition to these orthopedic advantages, the hollow body of the invention can, as a result of its shape, also be used in areas accessible to the public, since in view of the flat resting surface, there is no danger of rolling away.

The hollow body of the invention can, in view of its development, furthermore be used as support for known chairs with backrest, as a result of which, for instance, an expensive substructure or support structure such as is indispensable for seat balls is no longer necessary, and the hollow body can thus be used without problem. Furthermore, in particular, a "retro-fitting" of the already existing seating possibilities or chairs is possible, since, in particular, the maximum dimension of the hollow body is preferably adapted to the size of the sitting surface of ordinary chairs.

The hollow body of the present invention preferably comprises a hollow-body skin consisting of a plastic which preferably contains, in particular, plasticized polyvinyl chloride (PVC).

In a preferred embodiment of the present invention, the skin of the hollow body has a thickness within the range of 1 to 10 mm, preferably 2 to 8 mm, and more preferably 4 to 6 mm.

In another preferred embodiment of the hollow body of the invention, the skin of the hollow body has, in predetermined regions, protruding developments which preferably have a thickness within the range of 0.05 to 0.5 mm, more preferably 0.1 to 0.4 mm, and even more preferably 0.2 to 0.3 mm.

In a preferred embodiment, the hollow body has a round or oval shape in cross section (substantially parallel to the plane of the sitting or resting region). Furthermore, the hollow body preferably has a height which amounts to 1/10 to 1/2, more preferably 1/8 to 1/3, and even more preferably 1/5 to 1/4 of the maximum width of the hollow body.

In another preferred embodiment of the present invention, the hollow body has a maximum width within the range of 20 to 60 cm, more preferably 30 to 50 cm, and even more preferably about 35 cm.

The hollow body is preferably filled with a fluid, which is preferably air or a liquid, particularly water.

BRIEF DESCRIPTION OF THE DRAWINGS

Further objects, advantages and features of the present invention will become evident from the following illustrative description of a preferred embodiment, read with reference to the accompanying drawing, in which.

DETAILED DESCRIPTION OF THE PREFERRED EMBODIMENT

Figure 1:
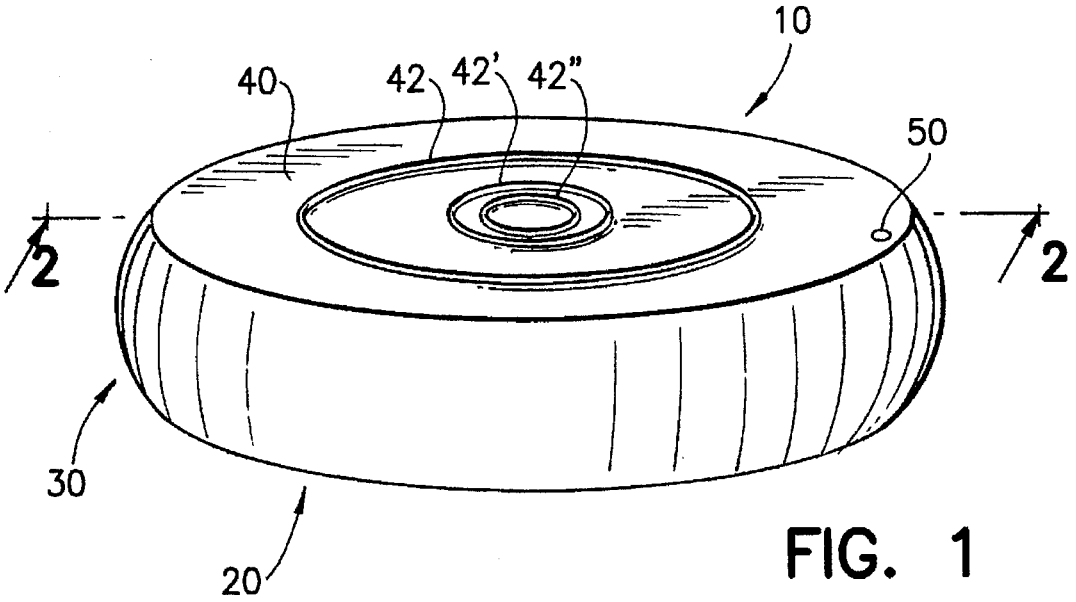
FIG. 1 is a perspective view of an embodiment of the hollow body in accordance with the present invention.
Figure 2:
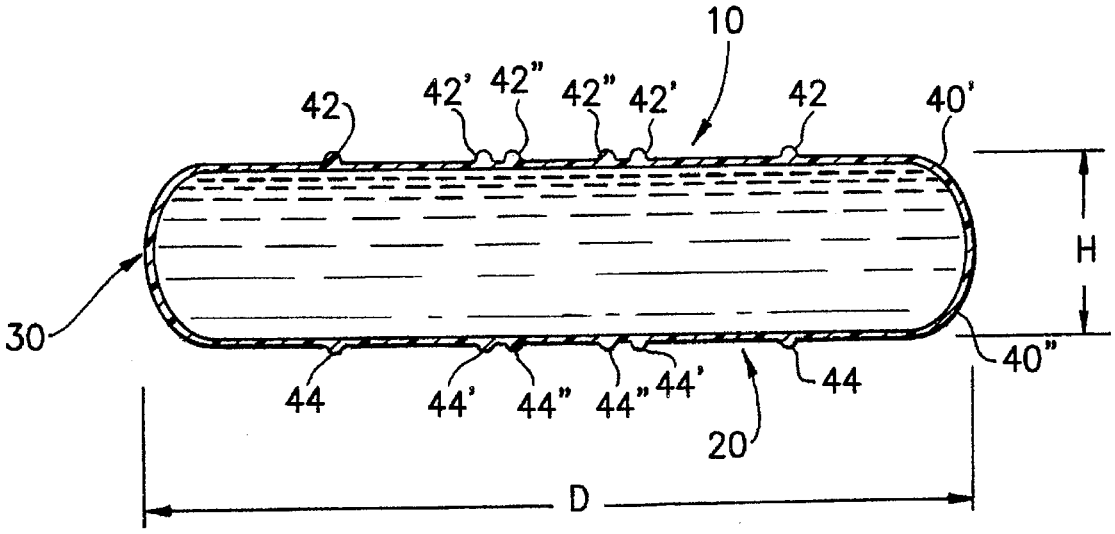
FIG. 2 is a sectional view along the line A—A of FIG. 1.

The embodiment of the present invention in the form of a hollow body or a seat disk or hollow disk, which is shown in FIGS. 1 and 2, comprises a flat sitting region 10, a flat resting region 20, and a donut-like transition region 30 which is arranged between them which forms the transition between the sitting region 10 and the resting region 20. When the resting region 20 of the hollow body rests, for instance, on a chair (not shown), the shape of the resting region 20 adapts itself, as a result of the elasticity of the skin of the hollow body 42, to the shape of the chair, which is generally flat. The transition region 30 levels out in part any irregularities which occur.

As soon as a person sits on the hollow body, the sitting region 10 adapts itself to the anatomy of the person. The donut-shaped or rounded transition region 30 transmits the load to the resting region 20, which rests on the chair and is supported on it. The donut-like transition region can, in particular, have a semicircular or semi-elliptical cross section or be pointed.

The skin 40 of the hollow body, which is formed in particular of two preferably identical molded parts 40' and 40" (FIG. 2), particularly of plasticized polyvinyl chloride (PVC), which are attached to each other, has protruding developments 42, 42', 42" on the sitting region 10 and/or protruding developments 44, 44" on the resting region 20. These developments serve, on the one hand, to stiffen the hollow body and, on the other hand, to increase the resistance to slipping of the sitting and/or resting region, while also serving for the aesthetic development of the hollow body itself.

The hollow body furthermore comprises a valve 50 by which the pressure in the inner space or inner volume of the hollow body can be adjusted. The hollow body has good resistance to tearing, in particular as a result of the low internal pressure or a slight stretching of the skin of the hollow body.

In an embodiment of the present invention not shown in the drawing, the skin of the hollow body has protruding developments also in the transition region.

The hollow body has a maximum dimension, in particular a width D, which is adapted to the sitting surface of a chair and amounts to about 35 cm. The hollow body is preferably a round or oval structure as seen in top view, as a result of which an advantageous good "dynamic seat" of the person sitting on the hollow body is obtained.

The height H of the hollow body is in particular about 8 to 10 cm and is, in particular, such that when the hollow body is used on a chair having a backrest, the person sitting thereon can lean comfortably against the backrest of the chair. This requirement advantageously permits use, for instance in schools, in which, in order to reduce the danger of injury to the children, it is required that the chairs have adequate backrests.

Figure 3:
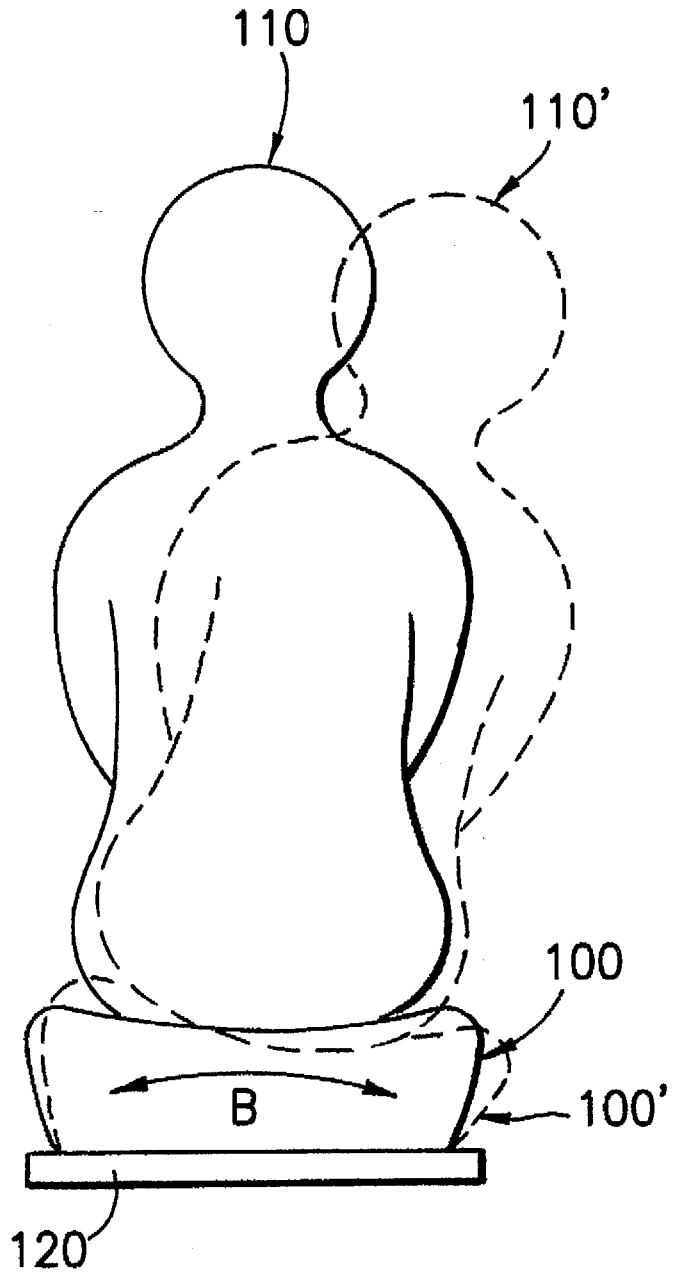
FIG. 3 is a diagrammatic showing of the sitting behavior in the case of the embodiment shown in FIG. 1.

FIG. 3 shows diagrammatically the movements produced by a person 110, 110' sitting on the hollow body 100, 100'. The movements are shown in exaggerated manner for purposes of illustration.

The elastic development of the skin of the hollow body 100, 100' which is formed, in particular, of plasticized polyvinyl chloride, has the result, as also in known sitting balls, that a part of the forces produced by the weight of the person are converted into shearing forces or forces substantially parallel to the surface 120 of the chair. These shearing forces result in slight tilting or whipping movements (indicated by the double-ended arrow 5 in FIG. 3) of the person 110, 110' sitting on the hollow body. The hollow body 100 can deform under this varying load (see below 100') and follows the movements of the person.

This behavior, known as "dynamic sitting", leads to the above-mentioned orthopedic and ergonomic advantages and thus produces a feeling of well-being on the part of the person sitting on the hollow body.

I claim:

1. A hollow body for use as a seat pad, said hollow body comprising a substantially planar resting region (20), a substantially planar sitting region (10) disposed in spaced parallel relationship to said resting region (20), and a circular transition region (30) extending continuously between and connecting peripheral areas of the resting region (20) and the sitting region (10) such that a single, continuous, uninterrupted fluid-receiving chamber is defined between said resting region (20), said sitting region (10) and said transition region (30), said resting and sitting regions (20, 10) each including outer surfaces facing away from said chamber, said outer surfaces of said resting and sitting regions (20, 10) each including an array of continuous concentrically disposed slip-resisting projections (42, 44) for preventing slipping of said resting region (20) relative to a supporting surface and for preventing slipping of a person seated on said sitting region (10).

2. A hollow body according to claim 1, characterized by the fact that the hollow body has a round shape as seen in top view.

3. A hollow body according to claim 1, characterized by the fact that the hollow body comprises a skin (40) of plastic.

4. A hollow body according to claim 3, characterized by the fact that the plastic contains plasticized polyvinyl chloride (PVC).

5. A hollow body according to claim 3, characterized by the fact that the skin (40) of the hollow body has a thickness within the range of 1 to 10 mm.

6. A hollow body according to claim 5, characterized by the fact that the skin (40) of the hollow body has a thickness within the range of 2 to 8 mm.

7. A hollow body according to claim 6, characterized by the fact that the skin (40) of the hollow body has a thickness within the range of 4 to 6 mm.

8. A hollow body according to claim 1, characterized by the fact that said projections (42, 42', 42", 44, 44', 44") have a thickness within the range of 0.05 to 0.5 mm.

9. A hollow body according to claim 8, characterized by the fact that said projections (42, 42', 42", 44, 44', 44") have a thickness within the range of 0.1 to 0.4 mm.

10. A hollow body according to claim 10, characterized by the fact that said projections (42, 42', 42", 44, 44', 44") have a thickness within the range of 0.2 to 0.3 mm.

11. A hollow body according to claim 1, characterized by the fact that the hollow body has a height (H) which is between 1/10 and 1/2 of the maximum width (D) of the hollow body.

12. A hollow body according to claim 11, characterized by the fact that the hollow body has a height (H) which amounts to 1.8 to 1/3 of the maximum width (D) of the hollow body.

13. A hollow body according to claim 12, characterized by the fact that the hollow body has a height (H) which is 1/5 to 1/4 of the maximum width (D) of the hollow body.

14. A hollow body according to claim 1, characterized by the fact that the hollow body has a maximum width (D) within the range of 20 to 60 cm.

15. A hollow body according to claim 14, characterized by the fact that the hollow body has a maximum width (D) within the range of 30 to 50 cm.

16. A hollow body according to claim 15, characterized by the fact that the hollow body has a maximum width (D) of about 35 cm.

17. A hollow body according to claim 1, characterized by the fact that the hollow body is filled with a fluid.

18. A hollow body according to claim 17, characterized by the fact that the fluid is air.

* * * * *